US008001623B2

(12) United States Patent
Gertsch et al.

(10) Patent No.: US 8,001,623 B2
(45) Date of Patent: Aug. 23, 2011

(54) ELECTRONIC HELMET

(76) Inventors: Jeffrey H. Gertsch, Palo Alto, CA (US); Ronald L. Gertsch, San Diego, CA (US); Christopher L. Gehrisch, Vista, CA (US); Matthew B. Gehrisch, Vista, CA (US); Martin D. McCune, San Diego, CA (US); William E. Swanson, San Diego, CA (US); David L. Williams, San Diego, CA (US); Justin K. Mann, Murrieta, CA (US); Sheldon A. Smilo, San Diego, CA (US); Benjamin G. Abad, Escondido, CA (US)

( * ) Notice: Subject to any disclaimer, the term of this patent is extended or adjusted under 35 U.S.C. 154(b) by 1195 days.

(21) Appl. No.: 11/138,933

(22) Filed: May 26, 2005

(65) Prior Publication Data

US 2006/0277666 A1 Dec. 14, 2006

(51) Int. Cl.
*A42B 1/24* (2006.01)

(52) U.S. Cl. ..... 2/422; 2/410

(58) Field of Classification Search ..... 2/410, 6.6, 2/411, 412, 422

See application file for complete search history.

(56) References Cited

U.S. PATENT DOCUMENTS

| | | | | |
|---|---|---|---|---|
| 4,321,433 | A * | 3/1982 | King | 455/344 |
| 4,648,131 | A | 3/1987 | Kawaguchi et al. | |
| 4,956,752 | A | 9/1990 | Foglietti | |
| 5,040,099 | A | 8/1991 | Harris | |
| 5,089,914 | A | 2/1992 | Prescott | |
| 5,207,500 | A | 5/1993 | Rios et al. | |
| 5,538,781 | A * | 7/1996 | Rao et al. | 442/217 |
| 5,572,401 | A | 11/1996 | Carroll | |
| 5,621,922 | A | 4/1997 | Rush, III | |
| 5,740,037 | A | 4/1998 | McCann et al. | |
| 5,743,621 | A * | 4/1998 | Mantha et al. | 362/105 |
| 5,857,215 | A * | 1/1999 | Fergason et al. | 2/8.3 |
| 5,864,481 | A | 1/1999 | Gross et al. | |
| H1790 | H | 3/1999 | Coleman | |
| 5,884,198 | A | 3/1999 | Kese et al. | |
| 6,009,563 | A | 1/2000 | Swanson et al. | |
| 6,157,298 | A | 12/2000 | Garfinkle et al. | |
| 6,283,344 | B1 * | 9/2001 | Bradley | 224/148.2 |
| 6,606,114 | B1 | 8/2003 | Gordon et al. | |

(Continued)

FOREIGN PATENT DOCUMENTS

GB 2 251 780 A 7/1992

(Continued)

OTHER PUBLICATIONS

Argus Rego Helmet Mounted Video Camera System, dated Apr. 9, 2004 (5 pages).

*Primary Examiner* — Shaun R Hurley
*Assistant Examiner* — Andrew W Sutton
(74) *Attorney, Agent, or Firm* — Tsircou Law, P.C.

(57) ABSTRACT

An electronic helmet is provided that includes a helmet body and an integrated electronic system disposed in the helmet body, providing a number of convenient functions. The helmet body has a hard outer shell and a hard inner shell mounted to the outer shell such that a cavity is defined between the outer and the inner shells. The inner shell can include suitable material to provide the wearer effective RF shielding from the electronic system, such as, nickel-plated carbon fiber to provide RF shielding. The helmet body further includes a shock-absorbent structure disposed between the inner shell and the head of a wearer.

13 Claims, 8 Drawing Sheets

U.S. PATENT DOCUMENTS

| | | | |
|---|---|---|---|
| 6,732,381 | B1 | 5/2004 | Lal |
| 6,798,392 | B2 | 9/2004 | Hartwell et al. |
| 2002/0044535 | A1 | 4/2002 | Tabata et al. |
| 2002/0160723 | A1 | 10/2002 | Yagi |
| 2002/0176595 | A1 | 11/2002 | Lazzeroni et al. |
| 2003/0036360 | A1 | 2/2003 | Russell et al. |
| 2003/0071766 | A1 | 4/2003 | Hartwell et al. |
| 2003/0234885 | A1 | 12/2003 | Pilu |
| 2004/0024502 | A1 | 2/2004 | Squires et al. |
| 2004/0027691 | A1* | 2/2004 | Himmele ..... 359/815 |
| 2004/0180691 | A1* | 9/2004 | Cascone ..... 455/557 |
| 2004/0244096 | A1* | 12/2004 | Claro ..... 2/195.2 |

FOREIGN PATENT DOCUMENTS

| | | |
|---|---|---|
| JP | 02-110999 | 4/1990 |
| JP | 08-032278 | 2/1996 |
| JP | 2001-168573 | 6/2001 |

* cited by examiner

ELECTRONIC HELMET

BACKGROUND OF THE INVENTION

The present invention relates generally to protective helmets and, more particularly, to such helmets incorporating electronic systems.

Helmets are used across a range of activities, to include skiing, bicycling, skydiving, waterskiing, to name just a few. Although helmet configurations vary between different activities, the primary function for all such helmets is to protect the user from head and facial trauma resulting from an impact. Generally, helmets include an outer shell made from durable plastic material surrounding inner layers of padding, e.g., foam material or air pads. For sports, a helmet's configuration will be suited to withstand the level of impact anticipated for a particular sport.

While engaging in many activities, particularly leisure and extreme sports, participants will often carry an array of electronics, e.g., cameras, music players, communication devices, and image recorders. For example, participants often like to have videos or pictures taken while engaging in the activity and will, therefore, carry a camera or video recorder. This can be dangerous, since the participants hands are needed to operate the devices. To free use of both hands, video and still cameras have been mounted to helmets. However, this can present other safety issues. For example, cameras typically have been mounted on the exterior of the helmet, sometimes requiring piercing the outer shell, hampering the impact resistance of the helmet. Moreover, such approaches fail to consider overall weight distribution of the helmet, often causing an awkward sense of imbalance, when the helmet is worn.

It should, therefore, be appreciated that there is a continuing need for a helmet that integrates electronic systems and yet is lightweight and promotes safety standards. The present invention fulfills this need and others.

SUMMARY OF THE INVENTION

The present invention provides an electronic helmet that includes a helmet body and an integrated electronic system disposed in the helmet body. In an exemplary embodiment, the electronic system provides the user with a number of convenient functions and is operable from a wireless remote control. The components of the electronic system are sufficiently small and rugged for use in the helmet, ensuring that the helmet is lightweight and durable. Moreover, the components are spaced about the helmet to provide even weight distribution to promote overall balance and safety.

In an exemplary embodiment of the invention, the helmet body has a hard outer shell mounted to a hard inner shell such that a cavity is defined between the outer and the inner shells. The inner shell includes suitable material to provide the user effective RF shielding from the electronic system. For example, the inner shell can include nickel-plated carbon fiber or other conductive material to provide RF shielding. The helmet body further includes a shock-absorbent structure disposed between the inner shell and the head of a user, when the helmet is worn.

In a detailed aspect of an exemplary embodiment, the helmet includes a plurality of housings disposed within and spaced about the cavity of the helmet body, each housing configured to secure components of the electronic system.

In another detailed aspect of an exemplary embodiment, the electronic system includes a digital camera subsystem and an image recording subsystem. The camera is preferably mounted with a field of view projecting from a front side of the helmet. The system can further include an image transmitter in communication with the camera and mounted within the cavity of the helmet, enabling real-time transmission of image data from the camera subsystem.

In yet another detailed aspect of an exemplary embodiment, the electronic system of the helmet includes a plurality of subsystems, providing a number of convenient functions, such as, digital image recording (still and motion), global positioning, audio, and communications, using a central controller that facilitates operation of the subsystems. For example, the positioning-system subsystem can provide position data, to include longitude, latitude, altitude, speed, and directions of movement. The position data can, for example, be incorporated into image or audio data and transmitted periodically via the communications subsystem.

The communications subsystem can include an internal antenna and an antenna connector for attaching an external antenna, for extended range. For example, the communication subsystem in conjunction with an attached antenna can provide a range exceeding 20 miles. The communications subsystem can also be configured for voice activation, enabling hands-free operation and triggers automatic transmission upon detection of voice activity. A processor can control the audio output from both the communication subsystem and the audio subsystem to adjust volume of each. For example, the processor can mute the volume of the audio subsystem when the communications subsystem is in use.

The digital image subsystem can include a digital camera subsystem mounted with a field of view projecting from the front side of the helmet. An image recording subsystem is in communication with the camera within the cavity to receive digitally captured image data from the camera and store the data on digital memory. The image recording subsystem also receives audio output from an external microphone and a user's microphone, and records each on a separate audio channel. Recorded image data can be accessed via the communication ports to include the USB port and the wireless IR port or removable memory card, as desired. In an exemplary embodiment, the helmet includes the ability to provide "live" images and sound via the image-transmission subsystem.

For purposes of summarizing the invention and the advantages achieved over the prior art, certain advantages of the invention have been described herein. Of course, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment disclosed.

BRIEF DESCRIPTION OF THE DRAWINGS

Embodiments of the present invention will now be described, by way of example only, with reference to the following drawings in which.

DETAILED DESCRIPTION OF THE PREFERRED EMBODIMENTS

Figure 1:
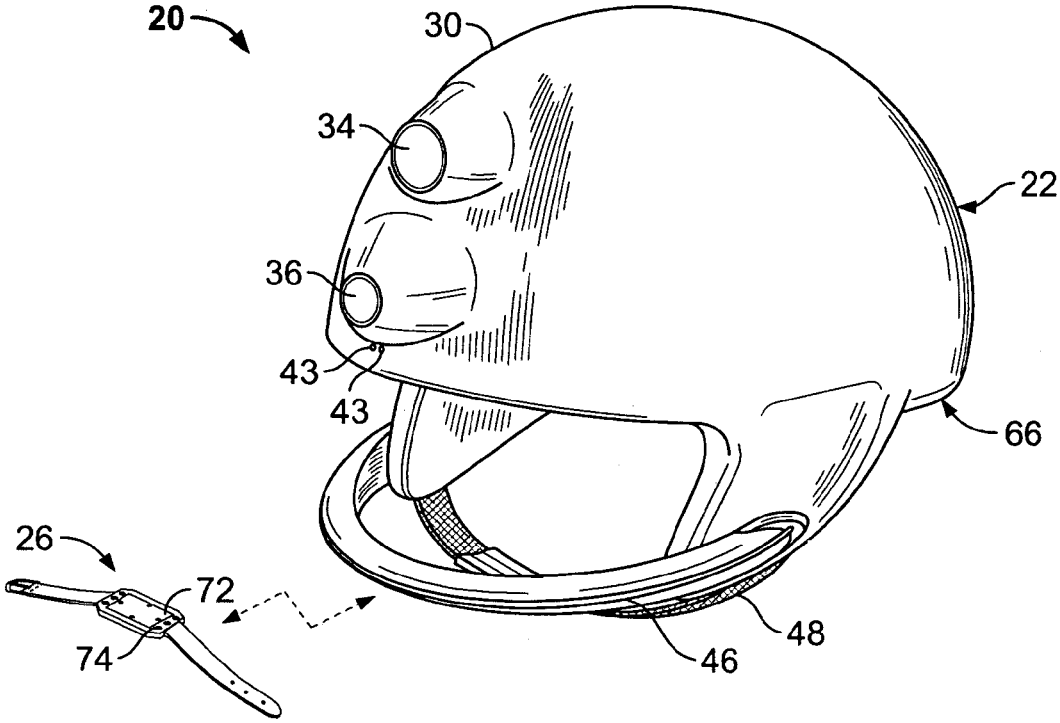
FIG. 1 is a perspective view of a helmet in accordance with the present invention, depicting the helmet in use and a wireless remote worn on the wrist.

Referring now to the drawings, and particularly FIGS. 1-4, there is shown a helmet 20 that includes a helmet body 22 and an integrated electronic system 24 having a plurality of subsystems, providing a number of convenient functions, such as image recording (still and motion), global positioning, audio for music playback and recording, and communications. The electronic system is disposed within the helmet body and is operable from a wireless remote control 26. The components of the electronic system are sufficiently small and rugged for use in the helmet, ensuring that the helmet is lightweight and durable. Moreover, the components are spaced about the helmet to provide even weight distribution to promote overall balance and safety.

The helmet 20 further includes a faceguard 46 and a chinstrap 48, to protect the user from injury. In addition, a hydration tube 49 (FIG. 2) is disposed in the faceguard, positioned for convenient access by the user. The hydration tube has a tip proximate to the user's mouth that can be operated by biting on it. At its opposite end, the tube can be connected to a liquid container, such as a water bladder. The electronic system 24 includes a voice microphone 51 attached to the faceguard for use by the user, for example, for use with communications subsystem and recording subsystem.

The electronic subsystem further includes speaker 47 positioned adjacent to the user's ears. The openings for the microphones (44, 51) and speakers 47 in the helmet are sealed, internally with a water-resistant material that allows sound to pass, such as those available from W.L. Gore & Associates. The seal keeps out water and other contamination while allowing air to pass, preventing pressure buildup.

The helmet 20 further includes a magnet disposed in the chinstrap 48 and a reed switch disposed in the helmet body 22. The switch is configured to power up the electronic system 24 of the helmet by positioning the magnet in proximity to the reed switch.

The helmet body 22 includes an inner shell 28 and an outer shell 30, defining a cavity 32 (FIG. 2) within which components of electronic systems 24 are mounted. In the exemplary embodiment, support posts 33 extend between the outer and the inner shells to increase the strength of the helmet and to facilitate distribution of impact forces. In this manner, the support posts inhibit the outer shell from inward compression onto the electronic components. The support posts are glued between the inner and outer shell. In various other embodiments, support posts can be molded extensions of the shells, or excluded entirely.

The outer shell 30 defines two openings, 34, 36, in the forward portion of the helmet, for use by a headlamp 38 and the digital camera 40, respectively, both of which are disposed within the cavity. Additional openings are also provided for an external microphone 44 (FIG. 2) and an IRDA transceiver. The external microphone is disposed between the digital camera and the headlamp. The inner and the outer shells are secured to each other along their outer edges, facilitating a watertight seal to protect the electronic components disposed in the cavity. Depending on particular needs, other embodiments are contemplated in which a watertight seal is not used.

The headlamp 38 includes a high-powered white LED, such as those available from Luxeon, Inc., and a focusing lens such as those available from Fraen Corp. The power controller receives commands to turn the light on and off and set the intensity, as desired.

The inner shell 28 is formed of material configured to provide RF shielding from the electronics disposed in the cavity, while satisfying other safety requirements, to include impact resistance and fire-resistance. The inner shell includes a flame-retardant additive, providing a flame-retardant rating "Vo," as tested under test method "UL 94." In the exemplary embodiment, the inner shell comprises molded polymer material having metallic fiber evenly disbursed throughout. Nickel-plated carbon fiber, such as that available from Chomerics Plastic Material, Inc., of Woburn, Mass., has been found to be effective, particularly for RF shielding. More particularly, the material of the inner shell includes a thermoplastic resin accounting for between about 50 percent and 90 percent of overall weight. The nickel-coated carbon fiber accounts for between about 10 and 40 percent of overall weight.

In use, the inner shell 28 both absorbs and reflects radiation, providing effective shielding in a range of about 70 dB, for frequencies from 800 MHz to 12 GHz. The inner shell has a thickness of about 2 mm. In other embodiments, the thickness can be varied to accommodate requirements, as needed.

Various other materials can be used in the inner shell 28, as requirements dictate. For example, in certain embodiments, the inner shell can further include carbon fiber, plastic, and fiberglass, singly or in combination. The inner shell can also provide RF shielding by laminating or painting rf-shielding material thereon.

The outer shell 30 is configured to provide substantial impact resistance and, in the exemplary embodiment, is molded from a copolymer resin, such as those available from GE Advanced Materials Plastics, under the trademarks LEXAN®, CYCOLOY®, ULTEM®, and XYLEX®. In other embodiments, the outer shell can be formed of various other materials having sufficient attributes, to accommodate the anticipated use. For example, carbon fiber and fiberglass can be used.

The helmet 20 is configured for use in various sporting activities, such as skiing, bicycling, waterskiing, to name a few. The helmet can also be beneficially used in other activities to include scientific research, law enforcement, and military applications. In the exemplary embodiment, the inner shell 28 and the outer shell 30 are secured to each other using sonic-welding to facilitate a watertight seal to protect the electronic components disposed in the cavity. Various other processes and seals can be used, as appropriate. For example, a gasket with silicon sealant can be used for a seal between the inner and the outer shell. Other embodiments are contemplated in which the helmet is configured for requirements of a particular activity.

The helmet body 22 further includes a shock-absorbent structure 42 (FIG. 3) disposed between the inner shell and the head of a user. In the exemplary embodiment, shock-absorbent structure is formed of a foam layer covered with material attached to the inner shell, however, various other materials that provide sufficient protection can be used.

Electronic System

Figure 2:
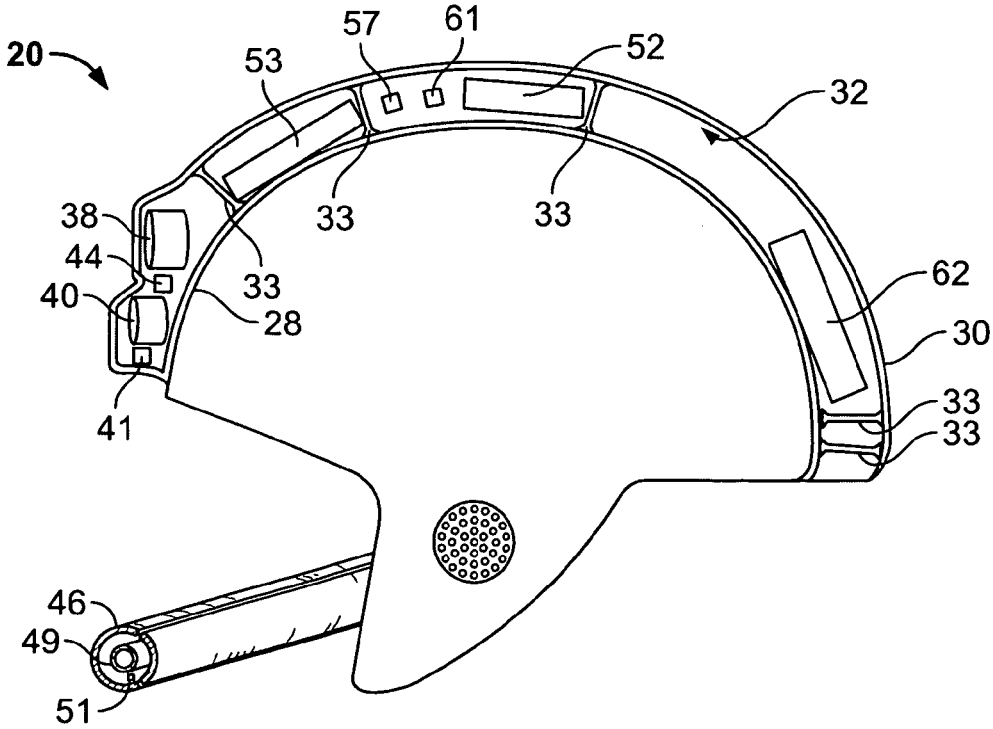
FIG. 2 is a cross-sectional view of the helmet of FIG. 1, depicting a helmet body having an inner shell and an outer shell.
Figure 3:
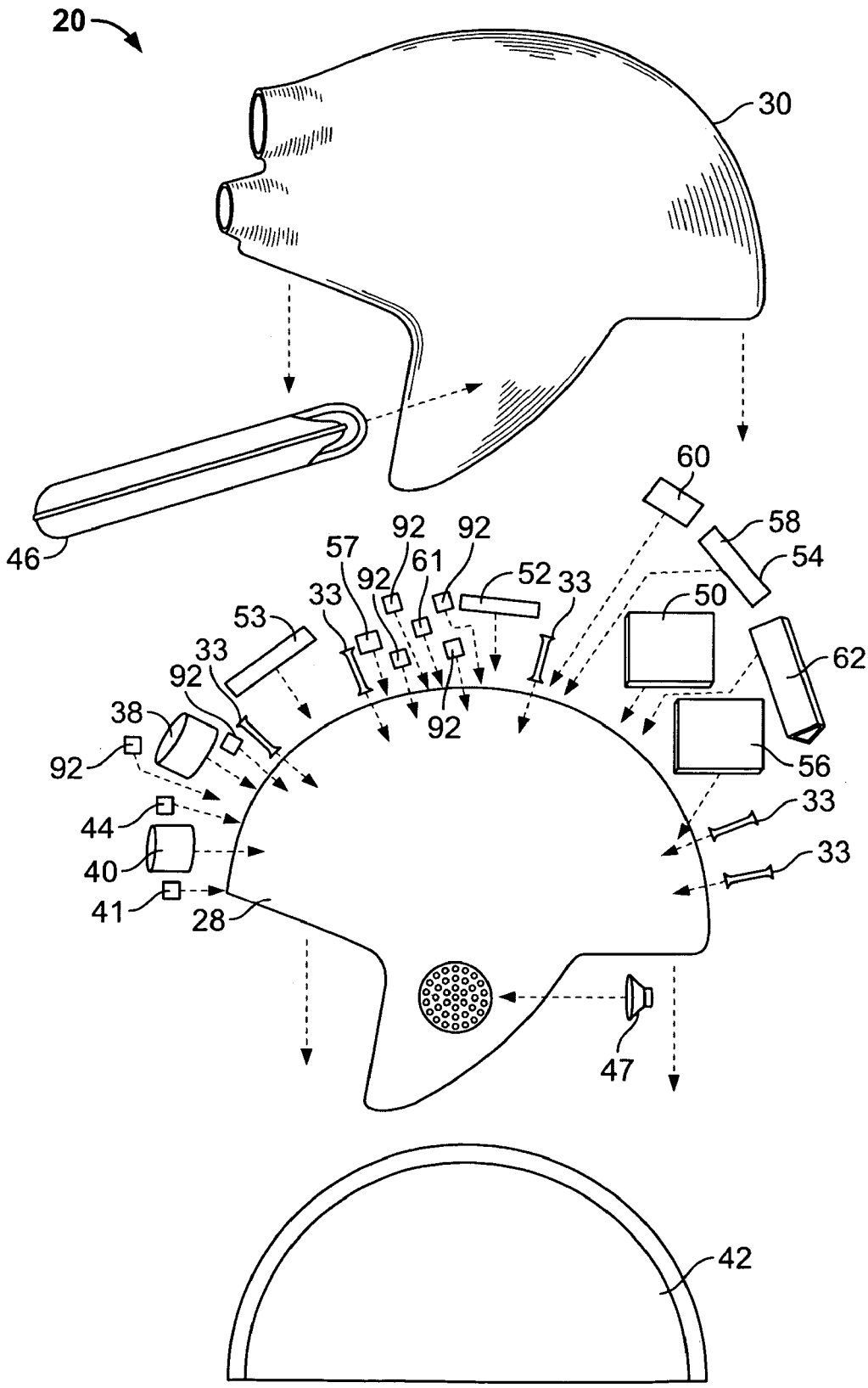
FIG. 3 is a partially exploded, perspective view of the helmet of FIG. 1.
Figure 4:
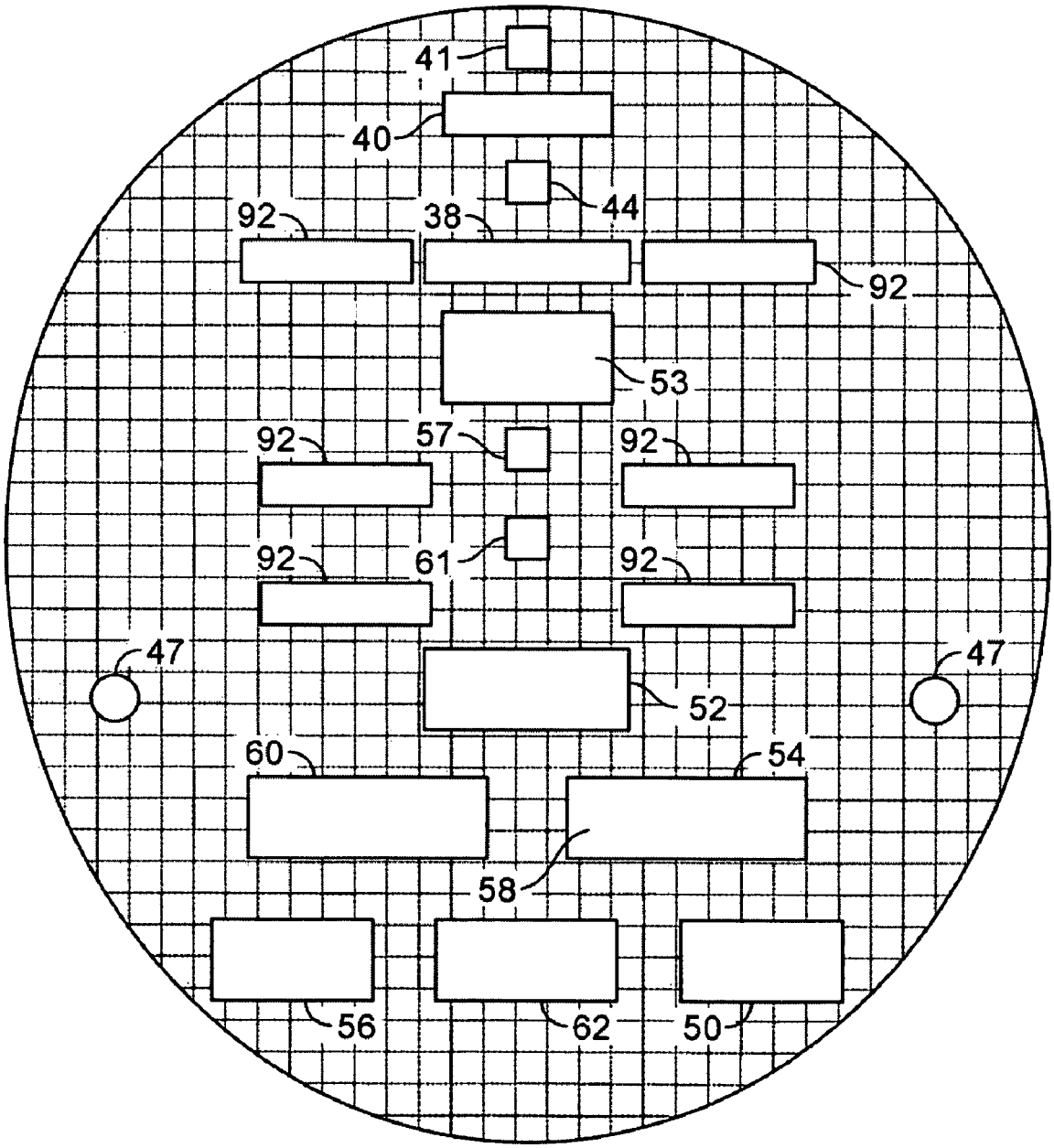
FIG. 4 is top plan view of the helmet of FIG. 1, excluding the outer shell, depicting the relative placement of the subsystems of the electronic system.

With continued reference to FIGS. 2 to 4, subsystems of the electronic system 24 are spaced about the helmet body 22. In the exemplary embodiment, the following subsystems are included: the headlamp 38, the digital camera 40, a power subsystem 50, a global positioning system subsystem 52, an audio subsystem 54, a communications subsystem 56, and a central controller subsystem 58, an image-transmission subsystem 60, and an image-recording subsystem 62. In certain other embodiments, each of the subsystems can be disposed in a separate housing. In yet other embodiments, components making up any of the subsystems can be disbursed about the helmet rather than confined to a particular housing or location within the helmet body.

As best seen in FIG. 4, the inner shell 28 includes grids lines spaced about one cm apart on its outer surface. The grid facilitates precise, uniform mounting of the subsystems, promoting overall balance of the helmet. In the exemplary embodiment, several components are aligned along the centerline of the helmet, for example, to include, from front to back, the digital camera 40, the headlamp 38, the positioning subsystem components 53, 52, and the image-recording subsystem 62. However, the subsystems need not be restricted to the particular locations of the exemplary embodiments. The subsystems can be attached using various approaches, e.g., epoxy, welding nuts, plastic mounting devices, and so on.

Figure 8:
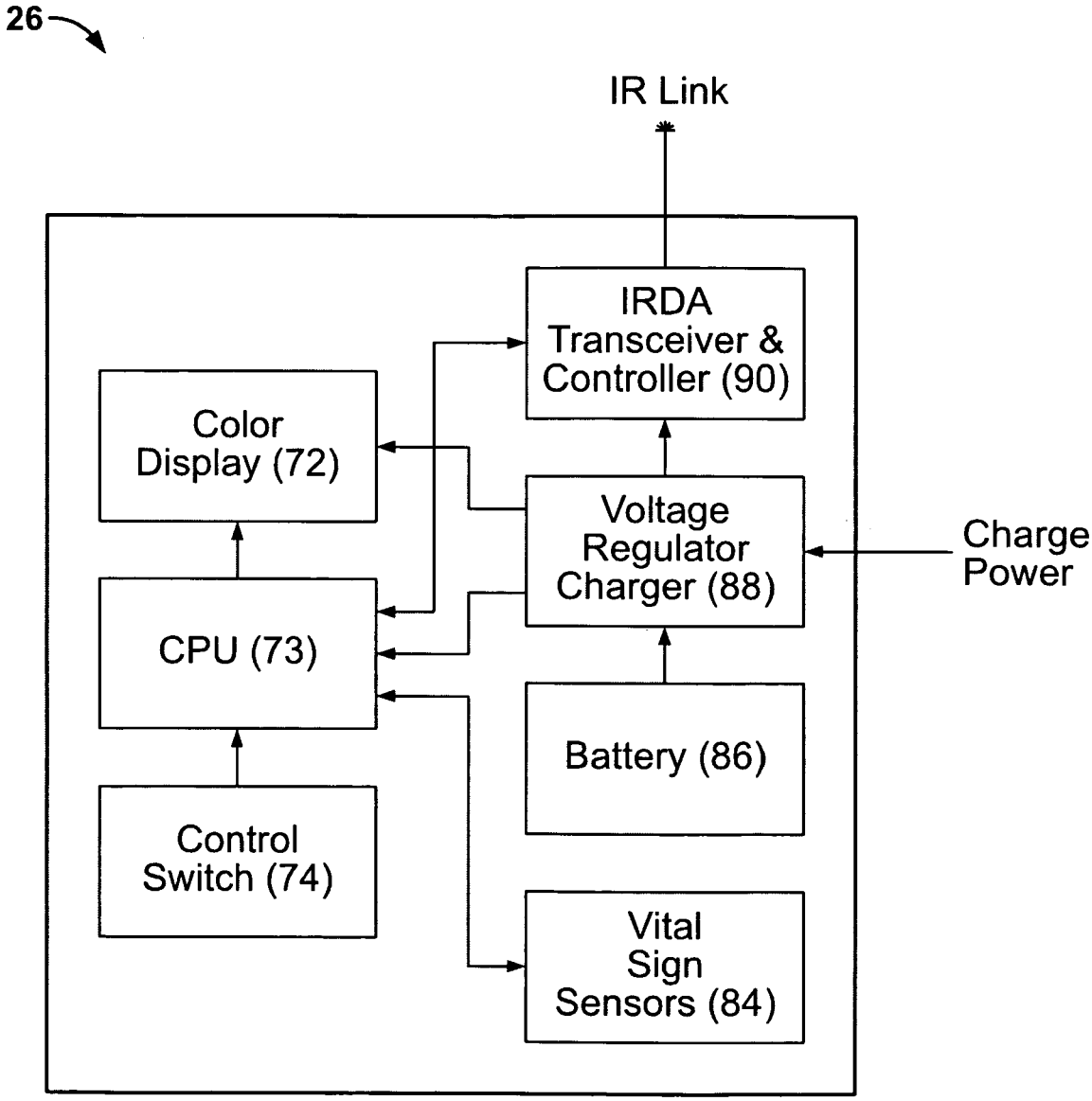
FIG. 8 is a simplified block diagram of the wireless remote control of the electronic system of FIG. 5.

In the exemplary embodiment, the remote control 26 fits on the user's wrist and can control subsystems of the electronic system. The remote includes a color display 72 that can show a menu-driven interface, images (taken with the digital camera 40), and GPS maps. The menus can be selected by a control switch 74. The remote communicates with the helmet via an IrDA transceiver and can communicate to a computer, e.g., to download GPS maps. The remote further includes sensors 84 (FIG. 8) to monitor vital signs (e.g., heart rate, oxygen saturation, body temperature, and others) of the user. The vital sign data can be displayed on the remote and can be transmitted to the helmet. In this manner, the vital sign data can be documented and transmitted via the communications subsystem 56 or the image-transmission subsystem 60.

Figure 5:
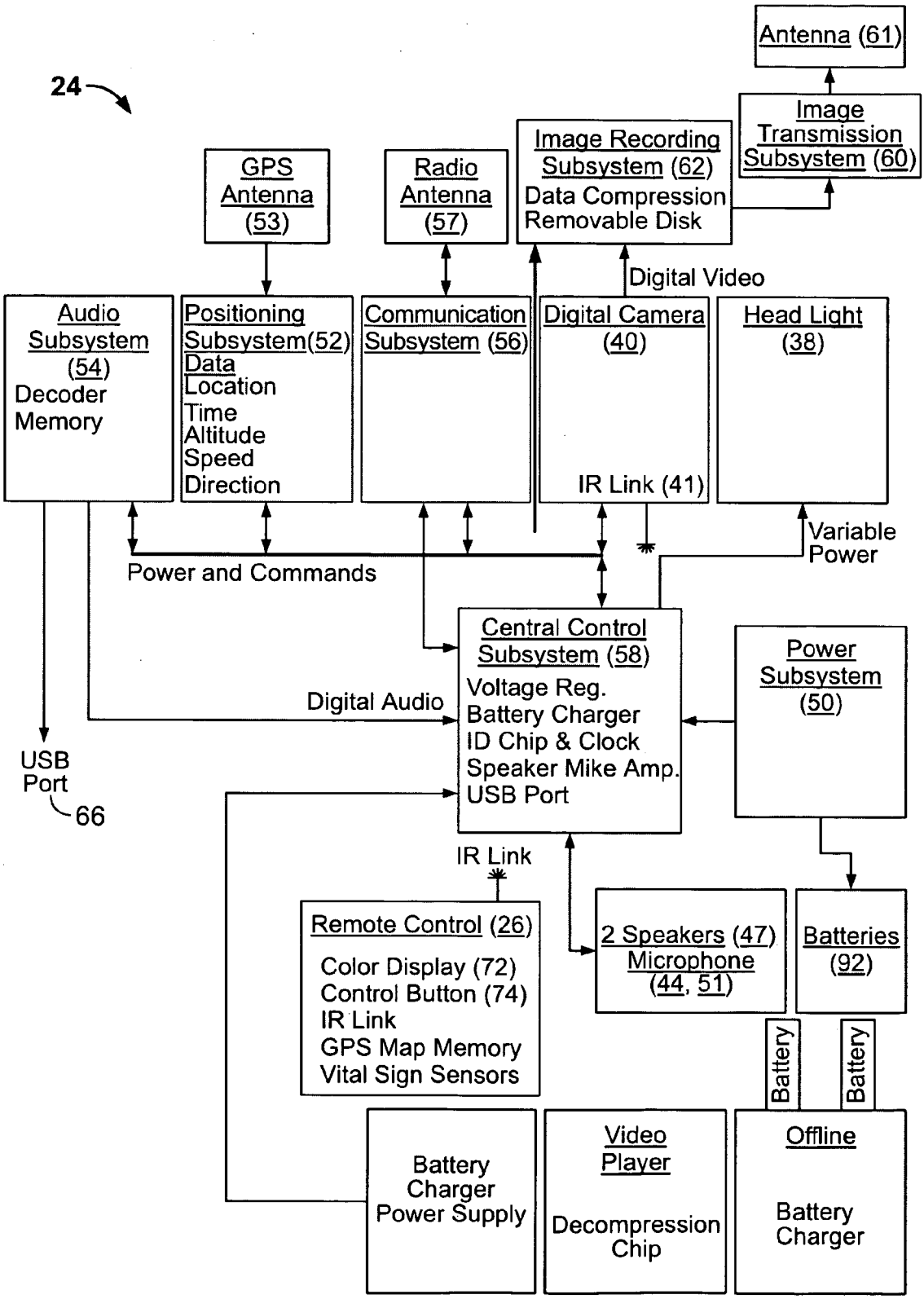
FIG. 5 is a simplified block diagram of the electronic system of the helmet of FIG. 1.
Figure 6:
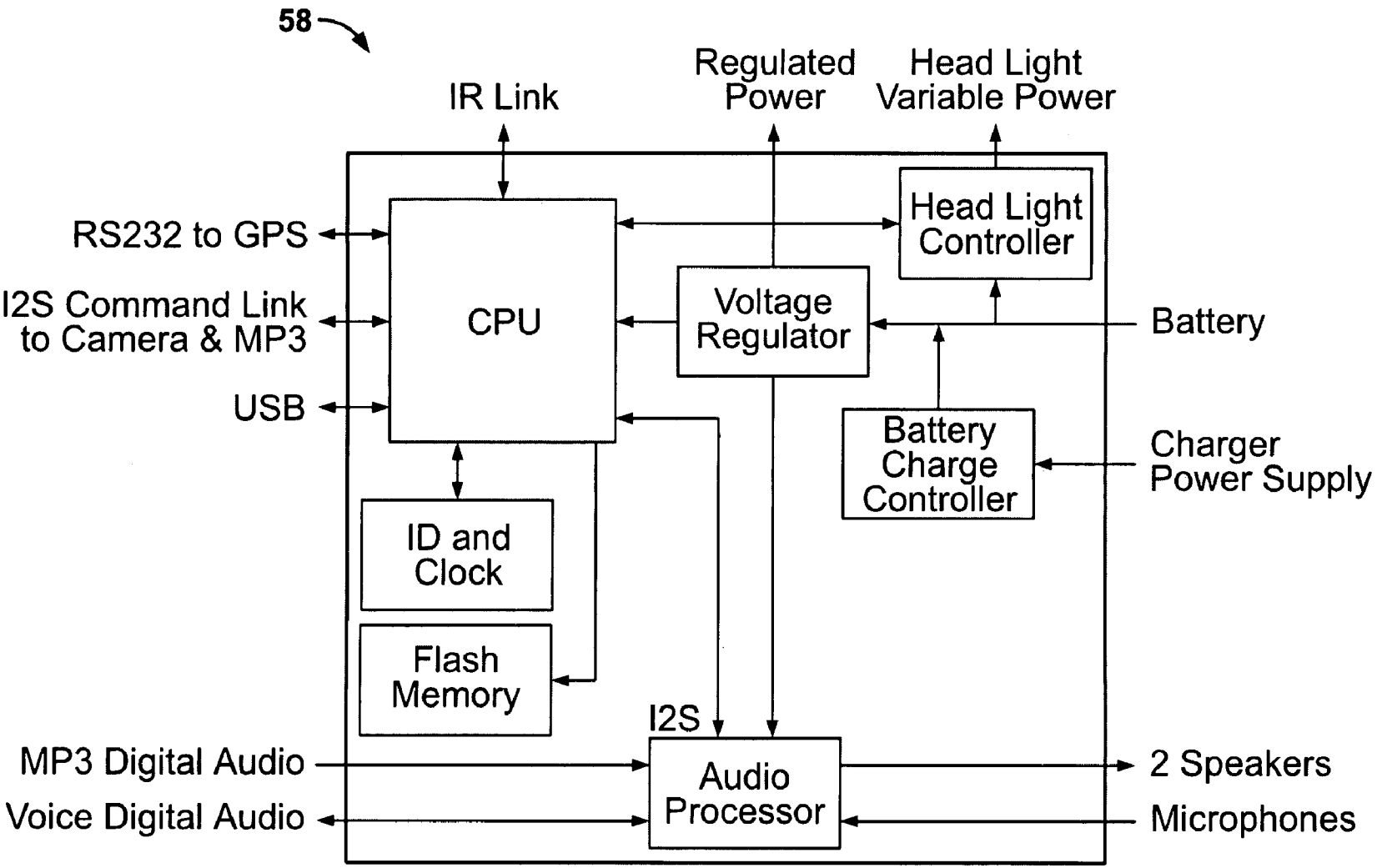
FIG. 6 is a simplified block diagram of the central controller of the electronic system of FIG. 5.

Referring to FIGS. 5 and 6, the central controller 58 provides commands and regulates power to each of the subsystems, as well as, facilitates transfer of data among the various subsystems. For example, position data from the positioning subsystem 52 can be recorded on still shots and image recordings of an image subsystem 62. The central controller communicates with the remote control 26 via an IR port 64. The electronic system further includes a USB port 66 for interacting with the system and accessing system data. The detailed features and components of the subsystems are discussed in detail below.

Communications Subsystem

Figure 7:
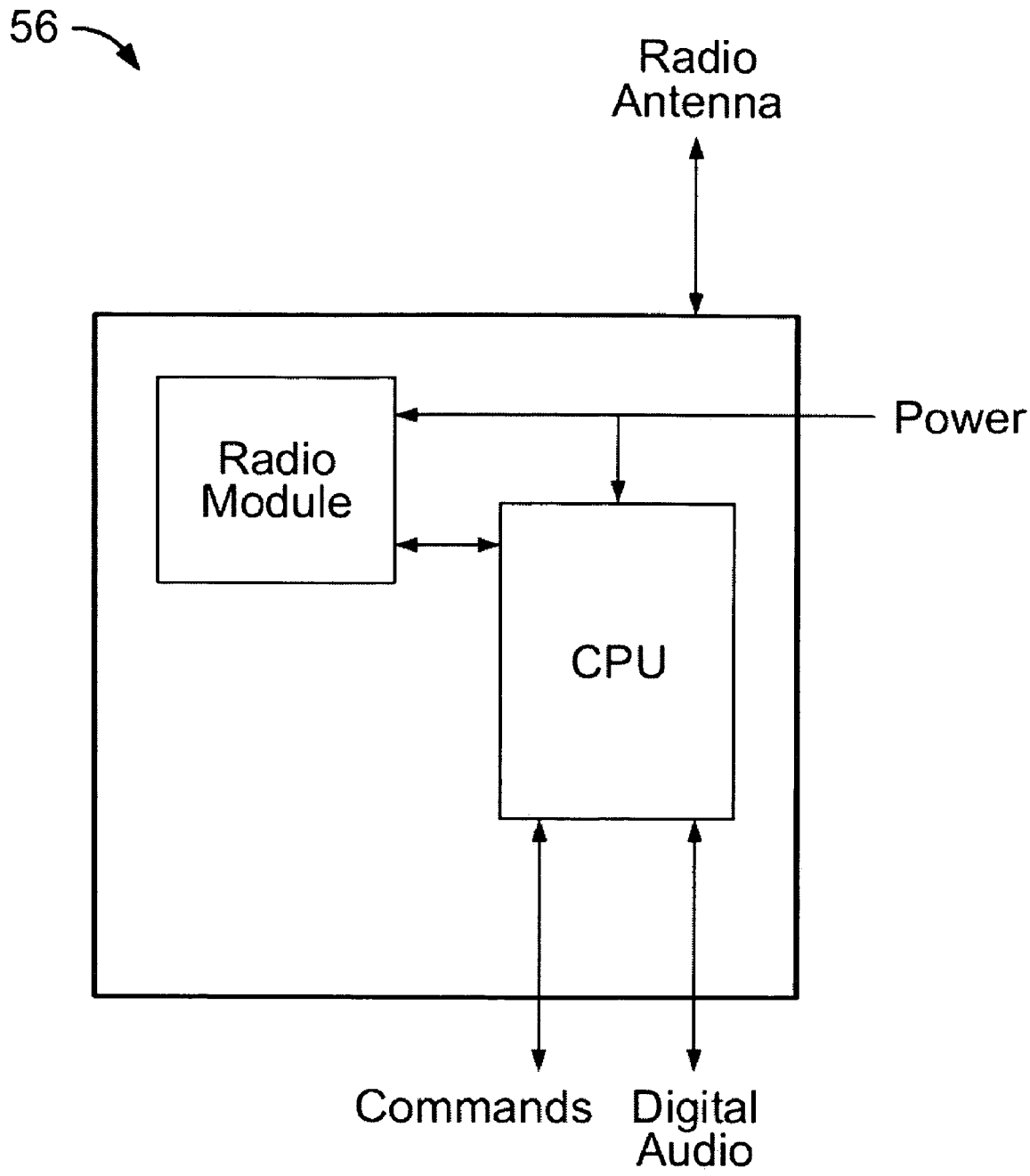
FIG. 7 is a simplified block diagram of the communications subsystem of the electronic system of FIG. 5.

With reference to FIGS. 5 and 7, the communications subsystem 56 includes a transceiver, a processor and an antenna, providing 32 radio channels operable in a range of about 2 to 5 miles, depending upon terrain. For extended range, the user can attach an external antenna via an antenna connector. For example, the communication subsystem in conjunction with an attached antenna can provide a range exceeding 20 miles, depending upon terrain. In yet other embodiments, an extended range antenna can be disposed in the helmet body. The communications subsystem is configured for voice activation, enabling hands-free operation and triggers automatic transmission upon detection of voice activity.

In the exemplary embodiment, the communications subsystem includes a radio transceiver, such as those available from Aerocomm, Inc. of Lenexa, Kans. (e.g., model AC4490) and Radiotronix, Inc. of Moore, Okla., and an embedded antenna such as those available from Linx Technologies of Grants Pass, Oreg. and Nearson, Inc. of Springfield, Va. In other embodiments, the helmet can include other communication methods, e.g., cellular phone, satellite communication, to name a few.

The processor of the communication subsystem controls the transceiver parameters and monitors signal strength. The audio output from the communication subsystem passes through a processor of the audio subsystem that will mute the volume of the audio subsystem when the radio is in use. The communications subsystem can vary power output, as needed. For example, high power output can be used to provide extended range, and lower power output can be used to conserve battery life. Data compression, such as adaptive differential pulse code modulation (ADPCM) can be used to facilitate bandwidth requirements with low error rates, even in noisy environments. The compression is performed by CML microcircuits CMX649 or similar unit.

Positioning System Subsystem

The positioning-system subsystem 52 is configured to receive Global Positioning System (GPS) satellite transmissions via a GPS antenna, such as those available from Aschtech Antenna, Toko America, Nearson, Centurion, and Linx. The positioning-system subsystem provides position data, to include longitude, latitude, altitude, speed, and directions of movement. In the exemplary embodiment, GPS receivers from various manufacturers can be used, e.g., Xemics (XE1610-OEMPVT subsystem) and Thales Navigation. In other embodiments, the positioning system subsystem can be configured for various other approaches for positioning.

Image Subsystems

As shown in FIG. 2, the digital camera 40 and an image recording subsystem 62 are in spaced locations within the cavity. The camera includes a fixed-focus wide-angle lens directed out the second opening 36 of the outer shell 30 such that its field of view projects from the front of the helmet. In the exemplary embodiment, the camera is configured with manual or automatic brightness control. Moreover, the digital camera can capture both still and motion images.

The image recording subsystem 62 is configured to receive digitally captured image data from the camera assembly and store the data on digital memory. In the exemplary embodiment, the image recording subsystem 62 utilizes MPEG4 data compression; however, various other methods of recording such data can be used, for example, MPEG2 and H264 compression. The image recording subsystem also receives audio output from an external microphone and a user's microphone, and records each on separate audio channels.

The recorder of the image recording subsystem 62 is about 2.25 in.×3.75 in.×0.70 in. In use, the image recording subsystem can record in different modes, e.g., a high quality mode and an extended play for lower resolution or lower frame rates. Recorded image data can be accessed via the communication ports to include the USB port 66 and the wireless IR port 64, as desired. In other embodiments, data can be retrieved through a removable memory device, such as memory drives, memory sticks, and so on. In the exemplary embodiment, image data is downloaded in a compressed format.

The helmet 20 further includes the ability to provide "live" image and other data via the image-transmission subsystem 60. The electronic system 24 can be configured to store a unique helmet ID number and position data, from the position subsystem, with the image of the subsystem. Thus, with the helmet 20, a user can thoroughly document all activities. In addition, using the broadcasting feature, such information can be transmitted to others in real-time.

Power Subsystem

Figure 9:
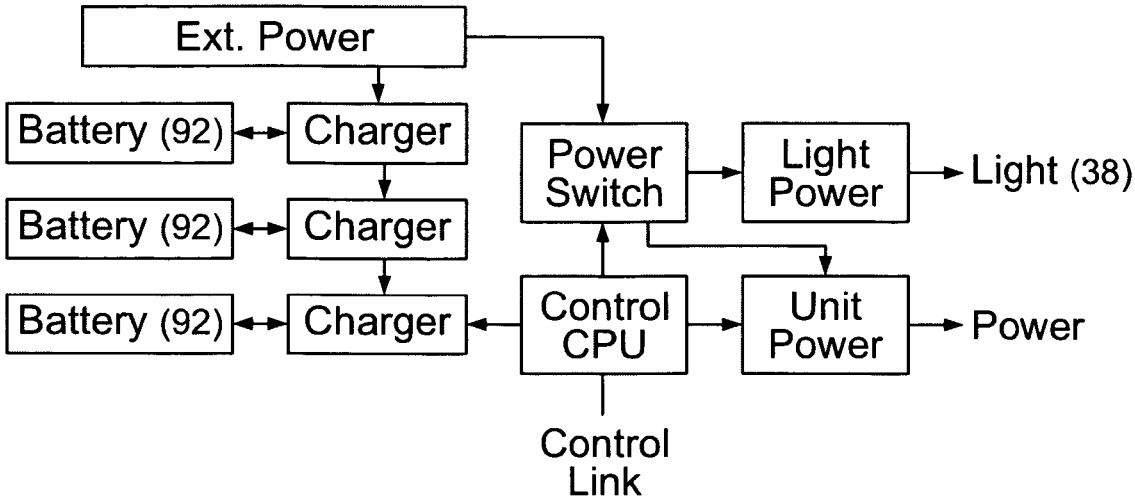
FIG. 9 is a simplified block diagram of the power controller of the electronic system of FIG. 5.

With reference now to FIG. 9, the power subsystem 50 includes three battery banks 92 that can be operably connected via a command to the various subsystems. In the exemplary embodiment, flat batteries with high power density are used, such as Lithium Ion types. The controller can dictate the distribution of power based upon demand and priority levels assigned to each subsystem. Also, the controller can regulate use of each of the battery banks, for example, reserving one bank for an emergency backup. In the exemplary embodiment, the batteries can be charged from an external power supply or a solar panel. Also, external battery packs can be connected to the helmet and worn by the user on a belt pack, for example.

Audio Subsystem

Figure 10:
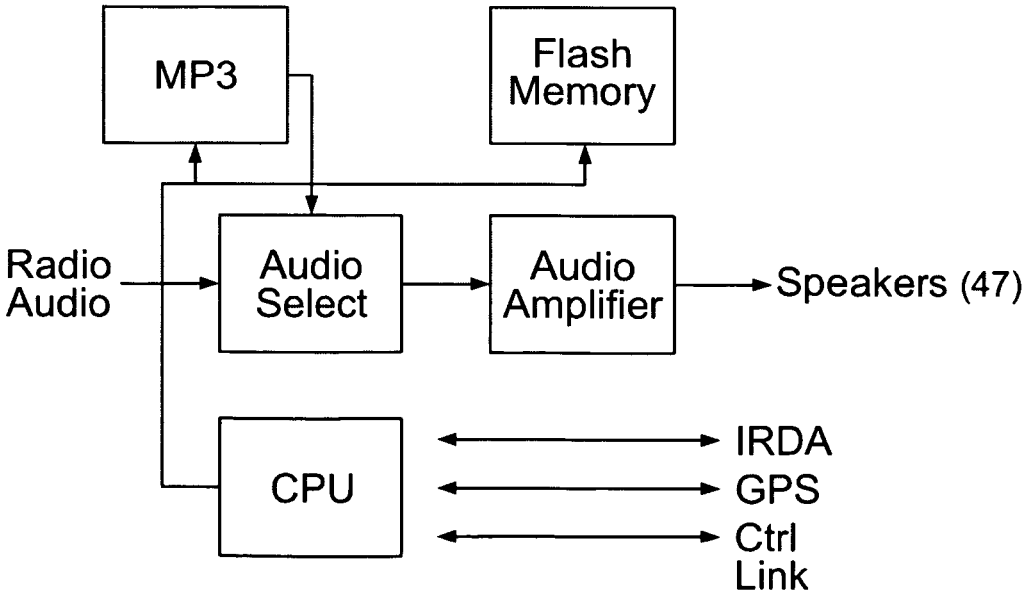
FIG. 10 is a simplified block diagram of the audio subsystem of the electronic system of FIG. 5.

With reference to FIGS. 5 and 10, the audio subsystem 54 is about 1.5 in.×1.9 in.×3 in. and can endure substantial impact forces. In the exemplary embodiment, the audio subsystem includes a MP3/USB chip such as those available from the following: Micronas, Inc.; VLSI, Inc.; ST Microelectronics, Inc.; Cirrus Logic, Inc.; Atmel, Inc. and others. The audio subsystem further includes flash memory 78.

The audio subsystem 54 is configured to play audio file in MP3 digital format and provides at least four hours of playtime with tone and volume adjustment. In other embodiments, the audio subsystem can be configured for other formats of digital recordings. The audio subsystem is also configured to store the preferred tone and volume, at system power down. In use, audio output from the audio subsystem automatically cuts off when the communication subsystem is in use. Audio files can be downloaded into digital memory through either the USB port 66 or the IR port 64. The audio subsystem can also record voice and external sounds via the corresponding microphones.

It should be appreciated from the foregoing that the present invention provides a helmet that includes a helmet body and an integrated electronic system disposed in the helmet body. In an exemplary embodiment, the electronic system provides the user with a number of convenient functions and is operable from a wireless remote control. The components of the electronic system are sufficiently small and rugged for use in the helmet, ensuring that the helmet is lightweight and durable. Moreover, the components are spaced about the helmet to provide even weight distribution to promote overall safety. In an exemplary embodiment of the invention, the helmet body has a hard outer shell and a hard inner shell mounted to the outer shell such that a cavity is defined between the outer and the inner shells. The inner shell includes suitable material to provide the user effective RF shielding from the electronic system. For example, the inner shell can include nickel-plated carbon fiber to provide RF shielding. The helmet body further includes a shock-absorbent structure disposed between the inner shell and the head of a user, when the helmet is worn.

Although the invention has been disclosed in detail with reference only to the preferred embodiments, those skilled in the art will appreciate that various other embodiments can be provided without departing from the scope of the invention. Accordingly, the invention is defined only by the claims set forth below.

What is claimed is:

1. An electronic helmet, comprising:

a helmet body having (i) a hard outer shell, (ii) a hard inner shell mounted to the outer shell such that a cavity is defined between the outer and the inner shells, the inner shell including rf-shielding material integrated therein and disposed substantially throughout for the protection of a wearer of the helmet, and (iii) shock-absorbent structure disposed between the inner shell and the head of the wearer; and an integrated electronic system disposed in the cavity defined between the outer and the inner shells; including a central controller for controlling a plurality of subsystems disposed in the cavity, the plurality of subsystems including (i) a digital image subsystem disposed in the cavity between the outer and the inner shells, the digital image recording subsystem having a camera mounted with a field of view projecting from a front side of the helmet and having an image recording device in communication with the camera, (ii) a rechargeable battery disposed in the cavity between the outer and the inner shells, (iii) an audio subsystem disposed in the cavity between the outer and the inner shells, (iv) a global positioning subsystem disposed in the cavity between the outer and the inner shells, and (v) a communications subsystem disposed in the cavity between the outer and the inner shells such that the head of the wearer is effectively shielded from transmissions by the inner shell.

2. A helmet as defined in claim 1, wherein the rf-shielding material includes metallic-coated carbon fiber embedded throughout the inner shell configured to provide effective shielding for frequencies between 800 MHz and 12 GHz.

3. A helmet as defined in claim 1, wherein the inner shell comprises polymer material molded with rf-shielding material distributed substantially throughout the inner shell to provide RF shielding.

4. A helmet as defined in claim 3, wherein the inner shell is molded to include a thermoplastic resin accounting for between 50 percent and 90 percent of overall weight of the inner shell and to further include the rf-shielding material having metallic fiber accounting for between 10 and 40 percent of overall weight of the inner shell.

5. A helmet as defined in claim 3, wherein the inner shell is molded to further include a flame-retardant additive.

6. A helmet as defined in claim 3, wherein the rf-shielding material includes a metallic-coated fiber embedded throughout the inner shell.

7. A helmet as defined in claim 1, wherein the outer shell and the inner shell are attached together by a water-resistant, sonic-weld seal.

8. A helmet as defined in claim 1, further comprising a chin strap having magnetic material configured to cooperate with a reed switch disposed in the helmet body.

9. A helmet as defined in claim 1, further comprising a faceguard having a hydration tube extending therethrough such that a tip of the hydration tube is accessible by the mouth of the wearer, when the helmet is worn, wherein the hydration tube is configured to be connected to a liquid container.

10. A helmet as defined in claim 1, wherein the digital image subsystem further includes an image transmitter in communication with the camera and mounted in a back side of the cavity, and the electronic system is configured to transmit image data, audio data, and position data in real-time via the image-transmitter.

11. A helmet as defined in claim 1, further comprising a wireless remote control configure to operate at least one subsystem of the integrated electronic system.

12. A helmet as defined in claim 1, the integrated electronic system further including a headlamp oriented to emit light in front of the user, when the helmet is worn.

13. A helmet as defined in claim 1, the integrated electronic system further including a microphone and a speaker.

* * * * *